US005628176A

United States Patent [19]

Morhenne et al.

[11] Patent Number: 5,628,176

[45] Date of Patent: May 13, 1997

[54] HEATING APPARATUS FOR HEATING AN ADVANCING YARN

[75] Inventors: Siegried Morhenne, Breckerfeld, Germany; Peter Berger, Cornelius, N.C.

[73] Assignee: Barmag AG, Remscheid, Germany

[21] Appl. No.: 612,668

[22] Filed: Mar. 8, 1996

[30] Foreign Application Priority Data

Mar. 10, 1995 [DE] Germany ..... 195 08 519.1
Aug. 18, 1995 [DE] Germany ..... 195 30 360.1

[51] Int. Cl.[6] ..... D01H 7/92; D01H 7/46

[52] U.S. Cl. ..... 57/290; 28/249; 57/284

[58] Field of Search ..... 57/282, 284, 287, 57/288, 290; 28/240, 249, 250; 219/388

[56] References Cited

U.S. PATENT DOCUMENTS 2,990,670 7/1961 Kingsbury ..... 57/34
5,148,666 9/1992 Bauer et al. ..... 57/290
5,438,820 8/1995 Nakahara et al. ..... 57/290

FOREIGN PATENT DOCUMENTS 0412429 2/1991 European Pat. Off. .
2451415 3/1979 France .
2534598 2/1977 Germany .
4318675 12/1993 Germany .
4423202 1/1995 Germany .
WO94/295501 12/1994 WIPO .

*Primary Examiner*—William Stryjewski
*Attorney, Agent, or Firm*—Bell, Seltzer, Park & Gibson, P.A.

[57] ABSTRACT

A yarn heating apparatus for use in a yarn false twisting machine, which has an axial channel in which the yarn advances along a zigzagged path. To guide the yarn in the axial channel, yarn guides are provided, which are shaped as spaced apart protuberances on two metal strips. The metal strips are supported in contact with the side walls of the axial channel.

20 Claims, 5 Drawing Sheets

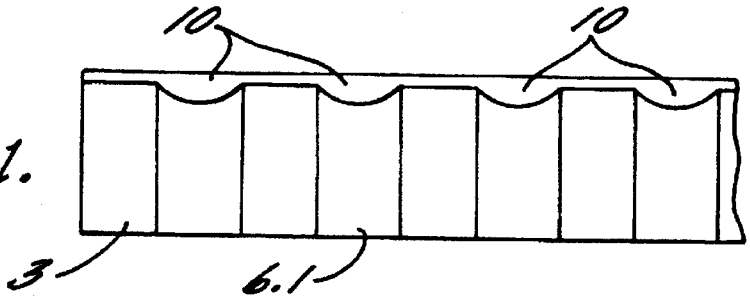
Fig. 1.
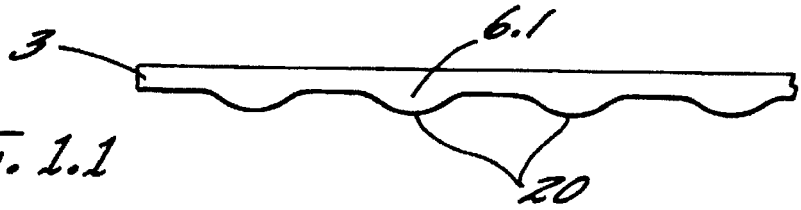
Fig. 1.1
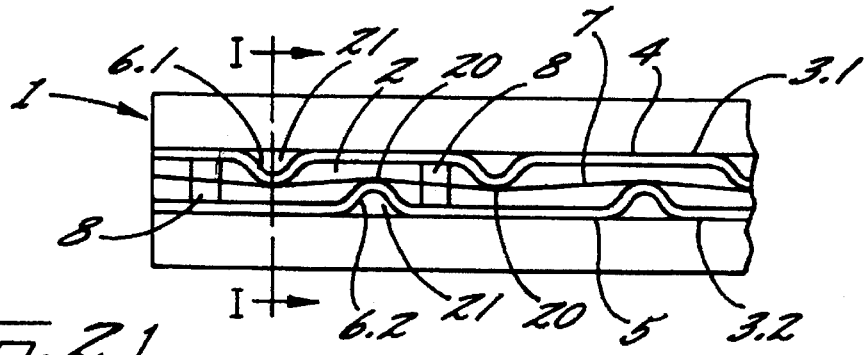
Fig. 2.1
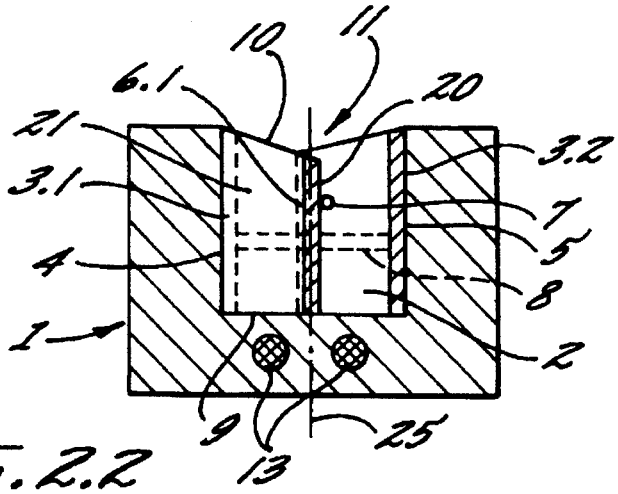
Fig. 2.2

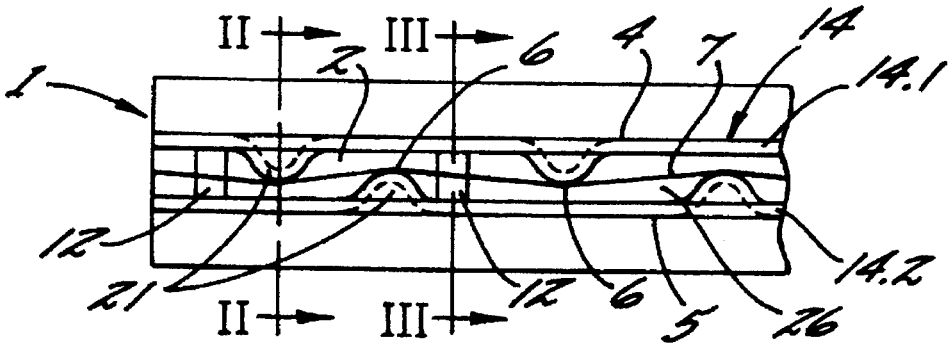
Fig. 3.1
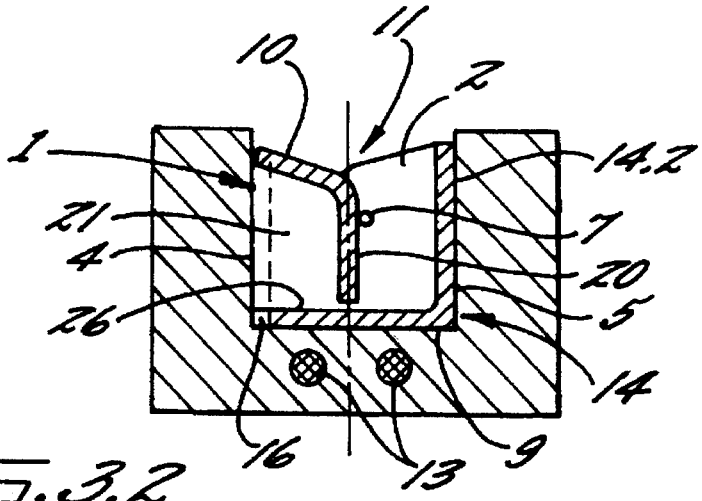
Fig. 3.2
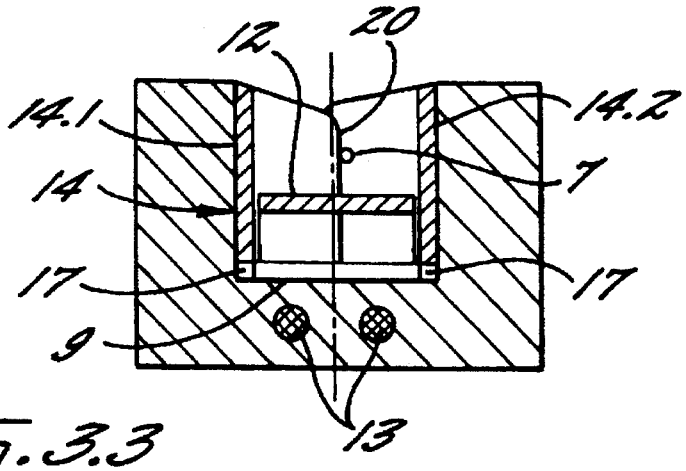
Fig. 3.3

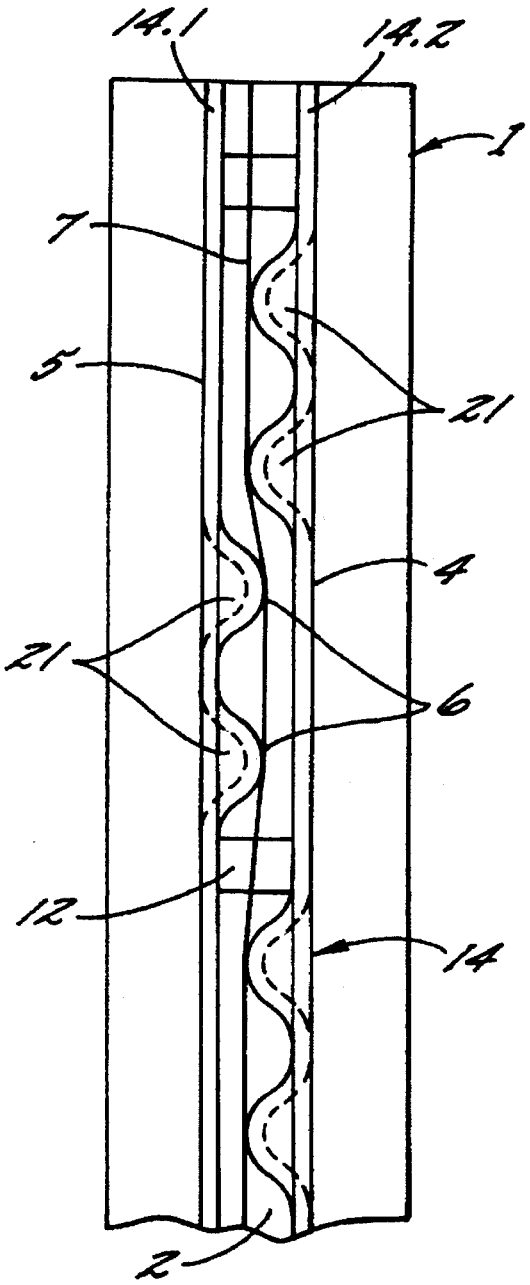
Fig. 4.1
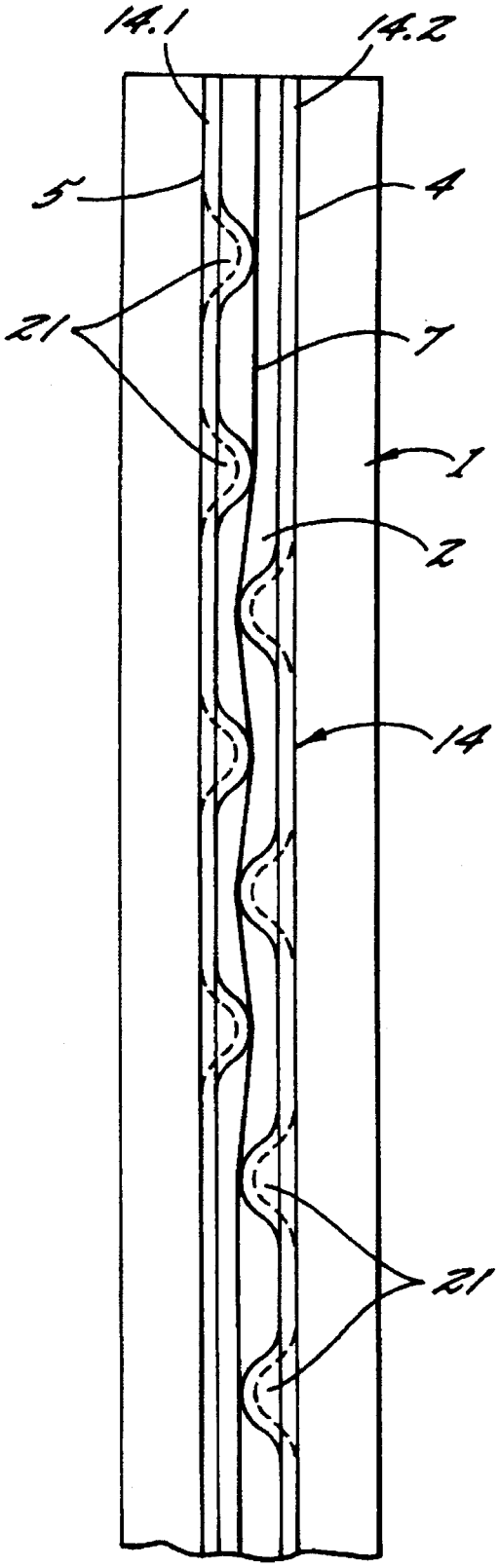
Fig. 4.2

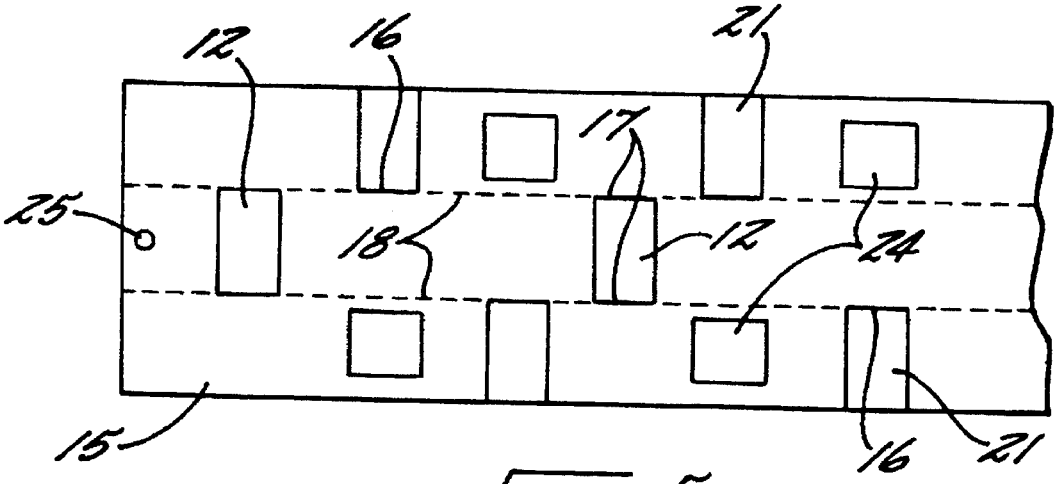
Fig. 5.
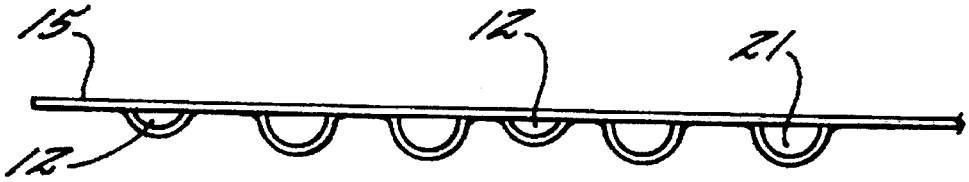
Fig. 5.1
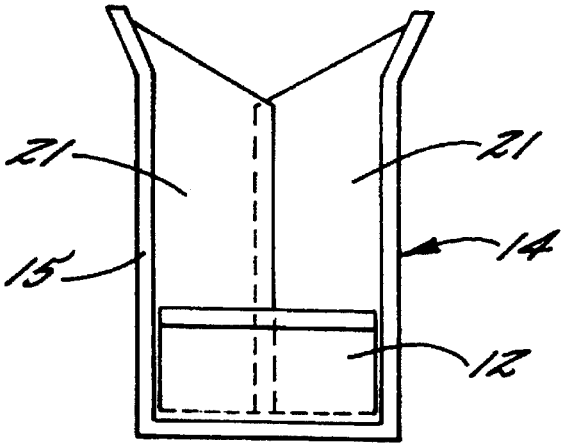
Fig. 5.2

HEATING APPARATUS FOR HEATING AN ADVANCING YARN

BACKGROUND OF THE INVENTION

The present invention relates to a heating apparatus for heating an advancing yarn and which is particularly adapted for use in a yarn false twist crimping machine.

For crimping synthetic filament yarns in a false twist crimping machine, it is common to provide heaters, through which a yarn is guided. The yarn advances in a heatable axial channel, the target temperature of the yarn being in a range from 150° C. to 230° C. The heater is operated at a temperature, which is substantially higher than 300° C. A heater may have several channels, each of which receives one yarn.

EP 0 412 429 B1 and corresponding U.S. Pat. No. 5,148,666 disclose a heater for a yarn false twist crimping machine, which has a heatable axial channel, through which the yarn advances along a zigzagged path. The zigzagged path is formed by several yarn guides, with one yarn guide being arranged at each reversal point of the line. The yarn guides are individual plates, which are inserted into the axial groove parallel to and equally spaced apart from one another.

In operation, the yarn guides of the above described heater will soil after a certain period of time, as a result of organic deposits and the like. To avoid an excessive deviation of the yarn guidance from a desired value, it is necessary to periodically remove and clean the yarn guides. In the known heater, each yarn guide must be removed individually, which is time consuming.

It is accordingly an object of the present invention to further develop the known heater such that the number of yarn guide elements is minimized, and the handling necessary for cleaning or changing of the yarn guides is simplified.

SUMMARY OF THE INVENTION

The above and other objects and advantages of the present invention are achieved by the provision of a yarn heating apparatus which comprises an elongate heater body having a channel therein which extends in an axial direction along the length thereof. The channel is of generally rectangular cross section, and defines parallel opposite side walls and a central plane which is parallel to and equally spaced between said opposite side walls.

Yarn guide means is disposed in the channel for guiding the advancing yarn axially along the channel in a laterally zigzagged path of travel, and the yarn guide means comprises a pair of metal strips disposed in the channel so as to overlie and contact respective ones of the opposite side walls. Each of the metal strips includes axially spaced apart yarn guides which extend laterally into the groove and beyond the central plane, and the yarn guides of each of said metal strips are axially offset from the yarn guides of the other of the metal strips. Heating means is also provided for heating the heater body.

The heating apparatus of the present invention is characterized in that the yarn guides are formed as integral protuberances on the two opposite metal strips. Since the protuberances are arranged alternately on the one and on the other metal strip, and since the protuberances project beyond the center plane of the groove, the yarn is caused to advance along a zigzagged path of travel.

The metal strips may be manufactured by hot or cold forming, so that the position and dimensions of the protuberances are dependent on a mold or tool, and so that they exhibit very consistent dimensions. As a result, the looping angles and the frictional conditions are equal at each deflection point of the yarn, which favors a smooth run of the yarn. The metal strips are supported on the opposite side walls of the axial channel and are positioned relative to each other such that opposite yarn guides, i.e., protuberances, are offset from one another.

For cleaning the yarn guides, both metal strips may be simply pulled out of the axial channel and, subsequently, be reinserted. To ensure that the yarn assumes a uniformly smooth run over the entire heating length, the protuberances are preferably arranged so that the protuberances of the two metal strips are equally spaced apart in the axial direction. However, at least some of the protuberances of the pair of metal strips may be unequally spaced apart in the axial direction. This unequal configuration is especially advantageous, when the yarn is to be heated very rapidly. For example, the protuberances may be arranged in a first section of the heating apparatus at a short distance from each other, so that the air jacket carried along by the yarn can be effectively stripped. In the further course of the heating length, the protuberances are further spaced apart from each other.

The arrangement of the protuberances on the metal strips may also be such that two successive protuberances are formed alternatingly on the one and on the other metal strip. This relationship typically allows the looping angle on each yarn guide to be advantageously reduced by about 50 percent.

Each of the metal strips may be fabricated from a sheet of metal, with the protuberances being formed thereon as corrugations, moldings, or impressions. This construction is advantageous by reason of the low manufacturing costs of the sheet metal strips. The corrugations may be formed by simple bending or stamping tools.

For purposes of positioning the opposite yarn guides, the metal strips may be interconnected by means of several crosspieces. Advantageously, the crosspieces are arranged in the vicinity of the channel bottom wall, so as to prevent the yarn from coming into contact with the heated surface of the channel bottom wall.

The yarn guide means of the present invention may take the form of a metallic channel member which is disposed in the channel and which has a U-shaped cross-sectional configuration which closely conforms to that of the channel in the heater body. The channel member thus comprises a base and opposite side strips. This construction is advantageous in that opposite protuberances may be initially formed on a flat metal plate, and so that the position of the protuberances relative to one another is defined exclusively by the bending or stamping tool. Furthermore, the arrangement of crosspieces between the sides may be omitted.

The U-shaped channel member may thus be shaped from a flat metal plate, by folding the plate along a fold line at the juncture between the base and each of the side strips. Also, the protuberances may be defined by an axially extending incision in the flat metal plate and by a deformed portion of the plate which is adjacent the incision. In addition, the base of the metallic channel member may include a plurality of axially spaced apart corrugations extending upwardly therefrom, which are formed between incisions extending along the fold lines. This construction provides for a cost favorable alternative for obtaining a shaped section from a flat metal plate. Also, the incisions which are parallel to the fold lines permit the corrugations to be formed in the base of the channel member in the folded condition. This construction also avoids having a corrugation extend into the fold line, which would strongly interfere with a subsequent forming process. The above described corrugations in the base of the channel member prevent the yarn from contacting the groove bottom wall and thus from being damaged as a result of thermal stress.

The upper edges of the protuberances on the yarn insertion side are preferably inclined downwardly toward the central plane of the channel. This results in a V-shaped or circular inlet in the axial direction, which permits a simple threadup of the yarn. If the protuberances are made in the form of a corrugation, each corrugation proceeds from the upper side of the axial channel with an increasing depth, thereby resulting in a V-shaped opening toward the yarn insertion side.

The protuberances are preferably of an arcuate configuration when viewed in plan, which allows a favorable looping angle and a small surface of friction to be achieved. The shaping of the protuberances must be accurately predefined, since it has a substantial influence on the running characteristics of the yarn.

It has been found that yarns of certain polymer types, for example, polyamide, must have a high degree of contact with the yarn guides for their heat treatment. This treatment may advantageously be realized by configuring the protuberances to include an axially elongate yarn guide surface which is generally parallel to the side walls.

To guarantee an adequately high resistance to wear, the metal strip may be provided on it inner side, at least in the region of the yarn guiding protuberances, with a coating of a hard material. To this end, the metal plate or the channel member with the protuberances formed thereon may be treated with nitride or boride. The coating thickness is from 10 to 30 μm. Surface hardnesses from 1,000 HV to 2,000 HV are obtained. In applications, which require a protection against wear, it is preferred to use protuberances with a chromium nitride or a titanium nitride coating. These relatively thin films from 6 to 9 μm are applied by the PVD or the CVD process. The surface hardness is in a range of ≧3,500 HV. At this point, it should be noted that the heating apparatus of the present invention is not limited to the aforesaid types of coating, and other commonly used types of coating may be applied.

The yarn guide means of the present invention may comprise a plurality of pairs of metal strips arranged serially in the axial direction. This arrangement has the advantage that several heating zones with a different yarn guidances may be formed, thus facilitating the optimization of temperature and yarn quality.

The heating zones of the heating apparatus may be flexibly combined by providing pairs of metal strips of the same lengths.

BRIEF DESCRIPTION OF THE DRAWINGS

Some of the objects and advantages of the present invention having been stated, others will appear as the description proceeds, when considered in conjunction with the accompanying drawings, in which:

FIG. 1 is a fragmentary perspective view of a metal strip with yarn guides formed thereon in accordance with the present invention;

FIG. 1.1 is a top plan view of the metal strip shown in FIG. 1;

FIG. 2.1 is a schematic top plan view of a heating apparatus with two corrugated sheet metal strips;

FIG. 2.2 is a cross sectional view along line I—I of FIG. 2.1;

FIG. 3.1 is a schematic top plan view of a heating apparatus with a corrugated profile;

FIG. 3.2 is a cross sectional view along line II—II of FIG. 3.1;

FIG. 3.3 is a cross sectional view along line III—III of FIG. 3.1;

FIGS. 4.1 and 4.2 are each a schematic top plan view of a heating apparatus with a corrugated profile;

FIG. 5 is a top plan view of an unfolded sheet metal plate with corrugations;

FIG. 5.1 is a side elevation view of the sheet metal plate shown in FIG. 5;

FIG. 5.2 shows a folded sheet metal plate or channel member with corrugations;

DETAILED DESCRIPTION OF THE PREFERRED EMBODIMENTS

Figure 6:
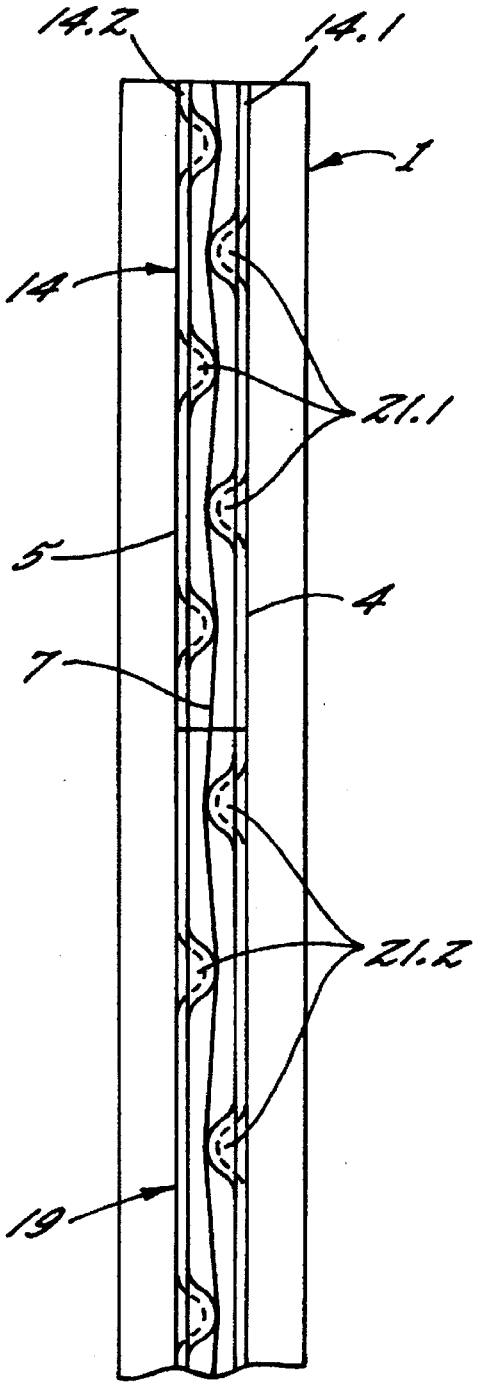
FIG. 6 is a schematic top plan view of a heating apparatus with two successive channel members.

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that the disclosure will be thorough and complete and will fully convey the scope of the invention to those skilled in the art.

A yarn heating apparatus which embodies the features of the present invention is indicated generally at 1 in the drawings, and it comprises an elongate heater body having a U-shaped channel 2 therein which extends in an axial direction along the length of the heater body. As seen for example in FIG. 2.2, the channel 2 includes a bottom wall 9 and parallel opposite side walls 4, 5, and the channel defines a central plane 25 which is parallel to and equally spaced between the opposite side walls.

Yarn guide means is disposed in the channel for guiding the advancing yarn 7 in a laterally zigzagged path of travel along the length of the channel 2. This yarn guide means a pair of metal strips 3 disposed in the channel so as to overlie and contact respective ones of the opposite side walls 4, 5.

In the embodiment of FIGS. 1 and 1.1, each metal strip 3 comprises a generally planar rear surface, and a front surface which includes along its axial direction a plurality of yarn guides that are formed in the shape of protuberances 6.1. The protuberances 6.1 preferably have a cross section in the shape of a divided circle or divided ellipse, and they are of equal size as can be noted from FIG. 1. In the region of the yarn guidance, the protuberances 6.1 are made cylindrical, so as to form an arcuate yarn guide surface 20. At one end of the yarn guides or protuberances 6.1 a bevel 10 is formed, which is inclined, so that it forms with the metal strip an acute angle. The bevel is located on the side from which the yarn 7 is inserted.

The metal strips 3 are shaped by means of cold or hot forming processes or by means of a machine cutting process from solid material. The width of metal strip 3, which results from the depth of protuberance 6.1 and the thickness of the sheet metal, must be somewhat larger than half the width of an axial channel 2 that is formed in the heating apparatus 1, so that the protuberances extend beyond the central plane 25.

Shown in FIG. 2.1 is a heating apparatus 1, which has an axial channel 2 arranged therein. Inserted into axial channel 2 are two metal strips 3.1 and 3.2. The metal strips 3.1 and 3.2 are supported on the opposite side walls 4 and 5 of the axial groove 2. In this embodiment, the protuberances 6.1 of metal strip 3.1 and the protuberances 6.2 of metal strip 3.2 are formed as corrugations 21 and arranged in face-to-face relationship offset from one another, the depths of protuberances 6.1 and the depth of protuberances 6.2 extending beyond the central plane 25 of the channel. The surfaces of the protuberances form yarn guide surfaces 20, and an inserted yarn 7 is deflected on the protuberances such that it forms a zigzagged course.

The metal strips 3.1 and 3.2 of FIGS. 2.1 and 2.2 are sheet metal strips with corrugations 21 formed therein by stamping. The two metal strips 3.1 and 3.2 are interconnected by means of crosspieces 8, so as to secure the metal strips 3.1 and 3.2 in their position relative to one another. The crosspieces 8 are arranged between the metal strips 3.1 and 3.2, preferably spaced above the channel bottom wall 9, so as to prevent the yarn 7 from coming into contact with the channel bottom wall 9 of the heating apparatus 1.

As shown in FIG. 2.2, the metal strips 3.1 and 3.2 terminate with their protuberances 6.1 and 6.2 in a bevel 10 on the yarn insertion side. The bevel 10 inclines downwardly toward the channel center, so as to form a V-shaped or a circular inlet 11 which facilitates the insertion of the yarn 7.

The yarn guide means of the embodiment of FIGS. 3.1 and 3.2 comprises a channel member 14. The channel member 14 has a U-shaped cross section which corresponds to the cross section of the axial channel 2, and it comprises a base 26 and two opposing side walls or strips 14.1 and 14.2. The yarn guides 6 may be stamped in the side strips 14.1 and 14.2 in the form of corrugations 21. The corrugations on side strips 14.1 and 14.2 alternate from one side to the other and guide the yarn in a zigzagged line along the axial channel 2. Also, the corrugations 21 are shaped such that the lateral depth of the corrugations 21 increases from the upper side of axial groove 2 to its maximum depth so as to facilitate the guiding of the yarn into its operative position. This results, as can be noted from FIG. 3.2, in a bevel 10 and, thus, in the formation of a V-shaped inlet 11, which facilitates likewise the insertion of the yarn.

To keep the yarn spaced above the channel bottom wall 9, bottom corrugations 12 are provided in the base 21 by stamping between side strips 14.1 and 14.2 of channel member 14. These bottom corrugations 12 extend transversely to the axial channel 2, as can be noted from FIG. 3.3, and they have a cross section in the shape of a divided circle or divided ellipse. However, other cross sections are possible. To keep the contact with the yarn as slight as possible, it will be advantageous to form the bottom corrugations higher at the start and at the end of the heating zone, so that there is only a slight contact with the bottom corrugations in the remaining range of the heating zone.

Shown in FIG. 4.1 is a channel member with side strips 14.1 and 14.2, each of which is provided by stamping with two successive corrugations 21, which alternate from one side strip to the other. This arrangement of the yarn guides permits the looping of the yarn to be reduced by 50% with the same number of yarn guides as in the heating apparatus of FIG. 3.1. Furthermore, in the heating apparatus of FIG. 4.1, the spacing between oppositely adjacent yarns guides 6 is made smaller at the inlet end of the heating zone than in the remaining length of the heating zone. This results in an irregular zigzagged course of the yarn. In particular in the inlet region, the short zigzag leads to a rapid heating of the yarn, since the air jacket carried along by the yarn is stripped several times in a rapid succession. In addition, the yarn is rapidly smoothed during its passage.

Shown in FIG. 4.2 is a heating apparatus 1 with an arrangement of yarn guides in the form of stamped corruptions 21, which permits at the beginning a small looping of the yarn on each yarn guide, so as to then change over to a regular zigzagged course with alternate use of single yarn guides.

Preferably, the channel member 14 is made from a flat sheet metal plate 15 as seen in FIGS. 5 and 5.1. To this end, the sheet metal plate 15 is folded along two lines 18 to a desired U-shape. The yarn guiding corrugations 21 and the bottom corrugations 12 are previously shaped in the sheet metal plate 15 by means of a bending stamp tool. To delimit the corrugations 21 and the bottom corrugations 12 relative to the fold line 18, incisions 16 and 17 are made before the shaping.

In the sheet metal plate 15, opposite to corrugations 21, inspection windows 24 may also be stamped out in each of the opposing side walls. These inspection windows 24 permit a visual inspection of the degree of soiling on the yarn guides in the dismantled state. Furthermore, at the one end of the sheet metal plate a hole 25 may be stamped out for applying a manipulating tool.

Shown in FIG. 5.2 is the sheet metal plate 15 folded to form the channel member 14 as describe above. This channel member with corrugations 21 and 12 is inserted, as illustrated, without further modification, into an axial channel 2 of a heating apparatus 1.

Shown in FIG. 6 is a heating apparatus 1 with channel members 14 and 19 one following the other in the longitudinal direction of axial channel 2. The metal strips are formed in this embodiment by side strips 14.1, 14.2 and 19.1, 19.2 of channel sections 14 and 19. Provided by stamping in side strips 14.1 and 14.2 are corrugations 21.1 and provided in side strips 19.1 and 19.2 are corrugations 21.2. All corrugations 21.1 and 21.2 have the same depth. The spacings between corrugations 21.1 on side strips 14.1 and 14.2 and the spacings between corrugations 21.2 and side strips 19.1 and 19.2 are uneven, so that the yarn is guided differently in the heating zones of channel sections 14 and 19.

Figure 7:
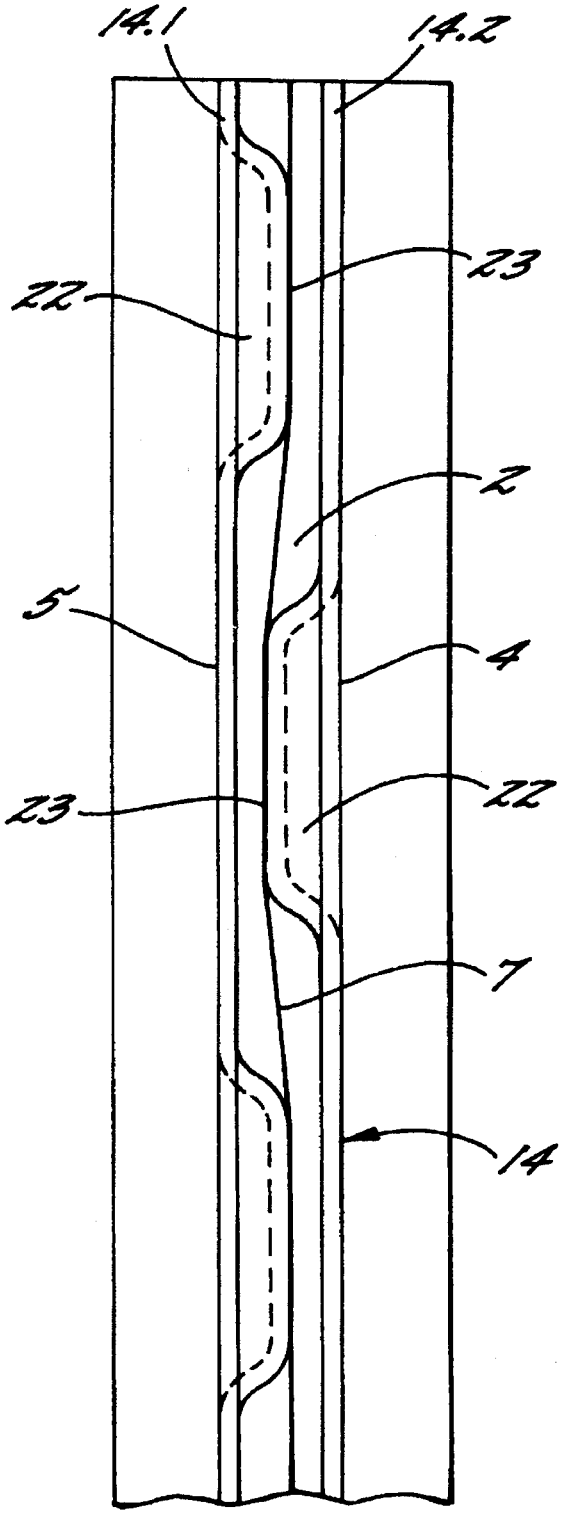
FIG. 7 is a schematic top plan view of a heating apparatus with a corrugated channel member.

The heating apparatus of FIG. 7 also comprises a channel member 14 that is inserted in an axial channel 2 with its side strips 14.1 and 14.2 being supported on side walls 4 and 5. In side strips 14.1 and 14.2, corrugations 22 are provided by a forming process. The corrugations 22 have a rectangular cross section, and form an axially elongate guide surface 23 on their longitudinal side. The corrugations 22 extend through the center plane of the axial channel 2, so as to guide the yarn 7 in a zigzagged course along the axial channel 2. In the region of the corrugations 22, the yarn 7 is in contact with guide surface 23, so that there results a great length of contact. This heating apparatus permits the yarn to be heated by contact.

The heating apparatuses of the above embodiments are heated by a resistance heater 13, which is in the form of a bar. This bar is inserted into a bore, which is axially arranged in the elongate heater body of the heating apparatus. To avoid losses of heat, the axial channel 2 may be closed in operation by a conventional lid, after the yarn is inserted.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. An apparatus for heating an advancing yarn comprising an elongate heater body having a channel therein which extends in an axial direction along the length thereof, with the channel being of generally rectangular cross section and defining parallel opposite side walls and a central plane which is parallel to and equally spaced between said opposite side walls, means for heating the heater body, and yarn guide means disposed in the channel for guiding the advancing yarn axially along the channel in a laterally zigzagged path of travel, said yarn guide means comprising a pair of metal strips disposed in the channel so as to overlie and contact respective ones of the opposite side walls, with each of the metal strips including axially spaced apart protuberances which extend laterally into said channel and beyond said central plane, and with the protuberances of each of said metal strips being axially offset from the protuberances of the other of said metal strips.

2. The yarn heating apparatus as defined in claim 1 wherein said protuberances of the pair of metal strips are equally spaced apart in the axial direction.

3. The yarn heating apparatus as defined in claim 1 wherein at least some of said protuberances of the pair of metal strips are unequally spaced apart in the axial direction.

4. The yarn heating apparatus as defined in claim 1 wherein one of the metal strips includes a plurality of groups of two axially spaced apart protuberances, and the other of the metal strips includes a plurality of groups of two axially spaced apart protuberances, and wherein the groups of protuberances alternate with each other in the axial direction.

5. The yarn heating apparatus as defined in claim 1 wherein each of said metal strips comprises a generally planar rear surface and a front surface which has the protuberances integrally formed therein.

6. The yarn heating apparatus as defined in claim 1 wherein the protuberances of each of said metal strips are deformed portions thereof.

7. The yarn heating apparatus as defined in claim 1 wherein said yarn guide means further comprises a plurality of axially spaced apart crosspieces extending laterally between said metal strips.

8. The yarn heating apparatus as defined in claim 1 wherein said protuberances each include an upper edge which is inclined downwardly toward said central plane so as to facilitate the thread-up of a yarn along the channel and between the protuberances.

9. The yarn heating apparatus as defined in claim 1 wherein said protuberances are of arcuate configuration when viewed in a direction which is perpendicular to said axial direction and parallel to said central plane.

10. The yarn heating apparatus as defined in claim 1 wherein at least some of said protuberances include an axially elongate yarn guide surface which is generally parallel to the side walls of the channel.

11. The yarn heating apparatus as defined in claim 1 wherein at least the protuberances of said metal strips are coated with a hard material coating.

12. The yarn heating apparatus as defined in claim 11 wherein said hard material coating is selected from the group consisting of a metal nitride and a metal boride.

13. The yarn heating apparatus as defined in claim 1 wherein said yarn guide means comprises a plurality of said pairs of metal strips arranged serially in the axial direction.

14. The yarn heating apparatus as defined in claim 13 wherein the axial spacing between the protuberances of successive pairs of metal strips is unequal.

15. An apparatus for heating an advancing yarn comprising an elongate heater body having a channel therein which extends in an axial direction along the length thereof, with the channel being of U-shaped cross sectional configuration and defining parallel opposite side walls and a central plane which is parallel to and equally spaced between said opposite side walls, means for heating the heater body, and yarn guide means disposed in the channel for guiding the advancing yarn axially along the channel in a laterally zigzagged path of travel, said yarn guide means comprising a metallic channel member disposed in said channel which has a U-shaped cross sectional configuration which closely conforms to that of said channel, with said metallic channel member comprising a base and opposite side strips, with said side strips disposed so as to overlie and contact respective ones of the opposite side walls of the channel, with each of the metal strips including axially spaced apart protuberances which extend laterally into said channel and beyond said central plane, and with the protuberances of each of said metal strips being axially offset from the protuberances of the other of said metal strips.

16. The yarn heating apparatus as defined in claim 15 wherein said metallic channel member comprises an integral sheet of metal which is axially folded along a fold line at the juncture between said base and each of said side strips.

17. The yarn heating apparatus as defined in claim 16 wherein said protuberances are each defined by an axially extending incision in the sheet of metal and by a deformed portion of the sheet of metal which is adjacent the incision.

18. The yarn heating apparatus as defined in claim 17 wherein said base of said metallic channel member includes a plurality of axially spaced apart corrugations extending upwardly therefrom, with each of said corrugations comprising a pair of laterally aligned and axially extending incisions in the sheet of metal and by a deformed portion of the sheet of metal which is between the pair of incisions.

19. The yarn heating apparatus as defined in claim 1 wherein said protuberances of the pair of metal strips are arranged such that the number of changes in direction in the zigzagged path of travel is smaller than the number of protuberances.

20. The yarn heating apparatus as defined in claim 19 wherein said protuberances are arranged in sets of at least two protuberances which extend from alternate ones of said side walls and so that the yarn advances between the protuberances of each set in a direction parallel to the central plane.

* * * * *